US007653325B2

(12) United States Patent
Tomiyori et al.

(10) Patent No.: US 7,653,325 B2
(45) Date of Patent: Jan. 26, 2010

(54) ELECTROSTATIC CHARGER

(75) Inventors: Minoru Tomiyori, Soraku-gun (JP); Susumu Murakami, Kizugawa (JP); Seiichii Kizu, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 196 days.

(21) Appl. No.: 11/819,219

(22) Filed: Jun. 26, 2007

(65) Prior Publication Data

US 2008/0044198 A1 Feb. 21, 2008

(30) Foreign Application Priority Data

Jun. 28, 2006 (JP) ..... 2006-178681
Jun. 28, 2006 (JP) ..... 2006-178682

(51) Int. Cl.
*G03G 15/02* (2006.01)
*G03G 21/18* (2006.01)

(52) U.S. Cl. ..... 399/100; 399/115

(58) Field of Classification Search ..... 399/100, 399/115

See application file for complete search history.

(56) References Cited

U.S. PATENT DOCUMENTS

| | | | | |
|---|---|---|---|---|
| 5,012,093 | A | 4/1991 | Shimizu | |
| 6,931,225 | B2 | 8/2005 | Yamashita | |
| 6,963,705 | B2 | 11/2005 | Quinones | |
| 2005/0074256 | A1* | 4/2005 | Yamashita | 399/100 |
| 2005/0265745 | A1* | 12/2005 | Takesawa et al. | 399/100 |
| 2007/0053718 | A1* | 3/2007 | Choi | 399/159 |
| 2007/0212105 | A1* | 9/2007 | Azumi et al. | 399/100 |
| 2008/0044198 | A1 | 2/2008 | Tomiyori et al. | |
| 2008/0085134 | A1* | 4/2008 | Takiguchi et al. | 399/100 |

FOREIGN PATENT DOCUMENTS

| | | |
|---|---|---|
| JP | 07-319260 | 12/1995 |
| JP | 9-166906 A | 6/1997 |
| JP | 09-211940 | 8/1997 |
| JP | 9-211940 A | 8/1997 |
| JP | 11-249393 | 9/1999 |
| JP | 11-288149 | 10/1999 |
| JP | 11-338265 | 12/1999 |

OTHER PUBLICATIONS

Office Action dated Jun. 11, 2009 issued in copending U.S. Appl. No. 11/714,172.
Office Action dated May 13, 2009 issued in copending U.S. Appl. No. 11/822,602.

* cited by examiner

*Primary Examiner*—David M Gray
*Assistant Examiner*—Rodney Bonnette
(74) *Attorney, Agent, or Firm*—Nixon & Vanderhye, PC

(57) ABSTRACT

An electrostatic charger according to the present invention includes a needle electrode, a support, and a cleaning member. The needle electrode has a linear array of needles. The support can move along the linear array. The cleaning member is supported by the support rotatably on an axis perpendicular to the linear array. While the support is moving with the cleaning member along the linear array, the cleaning member rotates, with the needles sinking in order into and subsequently coming in order out of the cleaning member. When the cleaning member makes each rotation while moving with the support, some of the needles sink in positions into the cleaning member where any other needles did not sink when the cleaning member made the previous rotation.

13 Claims, 11 Drawing Sheets

ELECTROSTATIC CHARGER

CROSS REFERENCE

This Nonprovisional application claims priority under 35 U.S.C. §119(a) on Patent Application No. 2006-178681 and No. 2006-178682 filed in Japan on Jun. 28, 2006, the entire contents of which are hereby incorporated by reference.

BACKGROUND OF THE TECHNOLOGY

The present technology relates to an electrostatic charger for charging to a uniform potential the peripheral surface of the photosensitive body of an apparatus for electrophotographic image formation.

An apparatus for electrophotographic image formation includes a photosensitive body and an electrostatic charger for charging the peripheral surface of the body to a uniform potential. The charger may be a noncontact charger out of contact with the photosensitive body. The noncontact charger includes an electrode. Application of high voltage to the electrode causes the electrode to discharge so as to charge the peripheral surface of the photosensitive body.

The charger electrode may be a needle electrode with needles. The needles extend toward the peripheral surface of the photosensitive body and are arrayed perpendicularly to the direction in which the surface moves. The portions of the needles which generate a high-voltage electric field attract ambient dust. Large amounts of dust on the needles prevent them from discharging properly.

JP-H11-338265A discloses a conventional electrostatic charger, which includes a needle electrode and a pair of pads supported on both sides of the needle array of the electrode. Movement of the pads along the needle array brings them into contact with the needles in order so as to remove dust from the needles.

The charger pads are made of felt or the like, so that they are not sufficiently elastic. This makes the tips of the electrode needles liable to deform. If the pads are made of felt, the felt fibers cut by the contact of the pads with the needles may stick to the needles. The pads come into contact with the sides of the needles which are parallel with the needle array. This makes it impossible to reliably clean the overall surfaces of the needle tips, to which the generation of a high-voltage electric field makes dust most liable to stick.

The assignee of this patent application has proposed an image forming apparatus including a photosensitive body and an electrostatic charger, which includes a needle electrode and a cleaning member. The electrode has an array of needles each extending toward the peripheral surface of the photosensitive body. The cleaning member is supported movably along the needle array between the electrode and the surface of the photosensitive body. While the cleaning member is moving along the needle array, the needle tips sink in order in the peripheral surface of the cleaning member and subsequently move out of it. This brings the overall surfaces of the needle tips into contact with the cleaning member so as to clean them reliably without deforming the needles and causing fibers to stick to the needles.

The cleaning member may include a roller and a shaft. The roller has a bore formed through it, in which the shaft is press-fitted. In this case, if the environment in which the electrostatic charger is used changes, or if the charger is used for a long time, the roller may crack when the cleaning member moves. If the roller cracks, the efficiency at which the electrode needles are cleaned decreases, and frequent replacement of the cleaning member decreases the efficiency of image formation of the apparatus, so that the apparatus cost rises.

SUMMARY OF THE TECHNOLOGY

One object is to provide an electrostatic charger which makes it possible to clean the overall surfaces of the tips of its electrode needles reliably without deforming the needles and causing fibers to stick to the needles.

Another object is to provide an electrostatic charger which makes it possible to clean its electrode needles at a high efficiency, and which includes a cleaning member having a long life.

An electrostatic charger includes a needle electrode, a support, and a cleaning member. The needle electrode has a linear array of needles. The support can move along the linear array. The cleaning member is supported by the support rotatably on an axis perpendicular to the linear array. While the support is moving with the cleaning member along the linear array, the cleaning member rotates, with the needles sinking in order into and subsequently coming in order out of the cleaning member. When the cleaning member makes each rotation while moving with the support, some of the needles sink in positions into the cleaning member where any other needles did not sink when the cleaning member made the previous rotation.

DETAILED DESCRIPTION OF THE TECHNOLOGY

The best mode of carrying out the present technology will be described with reference to the accompanying drawings.

Figure 1:
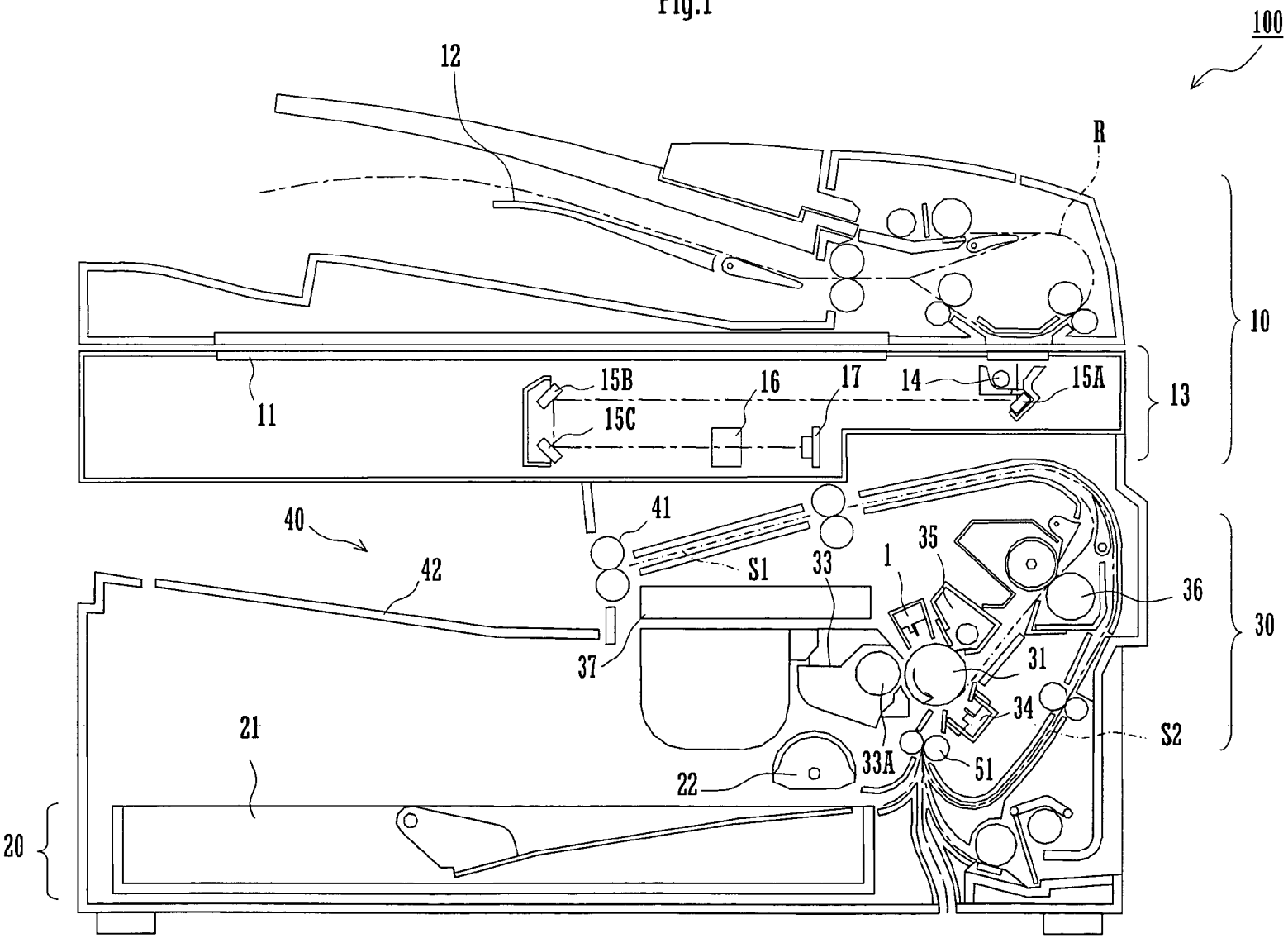
FIG. 1 is a front end view in cross section of an image forming apparatus including an electrostatic charger.

FIG. 1 shows an image forming apparatus 100 including an electrostatic charger 1. The apparatus 100 forms an image on a sheet of paper such as an OHP or another recording medium in the mode of image formation selected by the user from a copier mode, a printer mode, and a fax mode. The apparatus 100 can print images on both sides of a sheet of paper.

The apparatus 100 includes a document reader 10, a paper feeder 20, an image former 30, a paper delivery 40, and an operation panel (not shown).

The document reader 10 is positioned at the top of the apparatus 100 and includes a platen glass 11, a document tray 12, and a scanner optical system 13. The optical system 13 includes a light source 14, three reflecting mirrors 15A-15C, an optical lens 16, and a CCD (charge coupled device) 17. The light source 14 radiates light onto either the document placed on the platen glass 11 or the document being fed from the tray 12 and along the document feeding path R. The mirrors 15A-15C reflect the light reflected by the document and direct the reflected light to the lens 16. The lens 16 images the reflected light on the CCD 17, which outputs an electric signal based on the light.

The paper feeder 20 is positioned at the bottom of the apparatus 100 and includes a feed tray 21 and a pickup roller 22. The feed tray 21 holds sheets of paper. The pickup roller 22 rotates to feed a sheet of paper from the tray 21 to the paper feeding path S1. An image can be formed on the sheet being fed along the path S1.

The image former 30 is positioned under the document reader 10 and near the hand-feed tray (not shown). The image former 30 includes a laser scanning unit (LSU) 37, a photosensitive drum 31, and a fixing device 36. The drum 31 is surrounded by the electrostatic charger 1, a developing device 33, a transfer device 34, and a cleaner unit 35.

The paper delivery 40 is positioned over the feed tray 21 and includes a pair of reversible delivery rollers 41 and a delivery tray 42. The sheet fed along the paper feeding path S1 is delivered to the delivery tray 42 by the rotation of the delivery rollers 41 in the normal directions. The process for forming images on both sides of a sheet of paper includes the steps of forming an image on one side of the sheet, feeding the sheet with the image on it along the path S1, nipping the fed sheet between the delivery rollers 41, and subsequently rotating these rollers reversely to feed the sheet to the paper feeding path S2. The feeding of the sheet to the path S2 turns over the sheet, so that the other side of the sheet faces the photosensitive drum 31, and a toner image can be transferred to this side. The delivery tray 42 holds in a pile the sheets delivered from the delivery rollers 41.

A pair of resist rollers 51 is supported on the paper feeding path S1. When the start key on the operation panel is pressed, the pickup roller 22 turns to feed a sheet of paper to the resist rollers 51.

The resist rollers 51 are not rotating when the leading end of the fed sheet reaches them. The resist rollers 51 start to rotate when this sheet end is registered with the leading end of the toner image formed on the photosensitive drum 31 between the drum and the transfer device 34.

The image data read by the document reader 10 undergoes image processing on the conditions entered through the operation panel. Subsequently, the image data is transmitted as print data to the laser scanning unit 37. The electrostatic charger 1 charges the cylindrical surface of the photosensitive drum 31 to a preset potential. The scanning unit 37 forms an electrostatic latent image on the charged surface of the drum 31 by irradiating the drum surface through a polygon mirror and lenses (not shown) with a laser beam based on the image data. Subsequently, the toner sticking to the cylindrical surface of the MG roller 33A of the developing device 33 is attracted by and sticks to the cylindrical surface of the drum 31 according to the potential gaps on the drum surface, so that the latent image is visualized as a toner image.

The transfer device 34 transfers the toner image on the photosensitive drum 31 to a sheet of paper. The cleaner unit 35 recovers the toner remaining on the drum 31 after the transfer step.

After the transfer step, the sheet passes through the fixing device 36, which heats and presses it so as to melt the toner image and fix the image on the sheet. Subsequently, the delivery rollers 41 deliver the sheet to the delivery tray 42.

Figure 4:
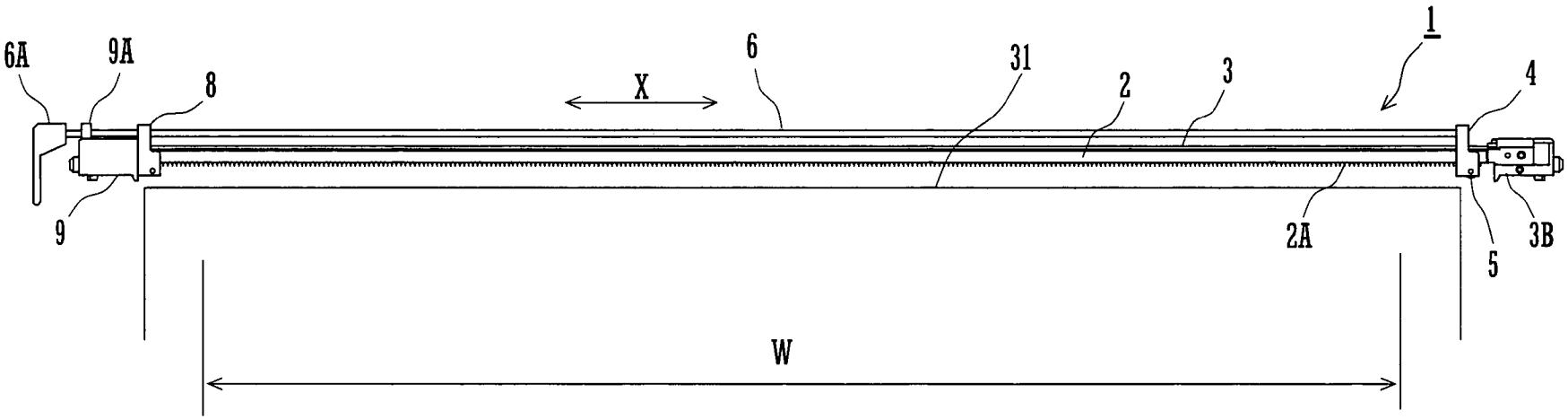
FIG. 4 is a right side view of the electrostatic charger according to the first embodiment.

With reference to FIGS. 2A, 2B, and 4, the electrostatic charger 1 includes a needle electrode 2, a holder 3, a support 4, a cleaning roller 5, an operating shaft 6, and a casing 7. The charger 1 is positioned over the photosensitive drum 31.

The needle electrode 2 is a thin metal strip extending in the directions X axial of the photosensitive drum 31, and is longer than the axial length of the cylindrical surface of the drum 31. The electrode 2 has a number of needles 2A extending downward from its bottom and arrayed at regular intervals over its whole length.

The holder 3 is formed of resin or other insulating material and includes a holding part 3A and an end part 3B. The holding part 3A holds the needle electrode 2 and is longer than the distance between both endmost needles 2A of the electrode. The thick hatches in FIG. 2A represent the cross-sectional shape of the holding part 3A which is perpendicular to the directions X. The end part 3B holds a terminal (not shown) in it, which connects the electrode 2 and a high-voltage power source (not shown).

The support 4 is open at its bottom and supported outside the holding part 3A slidably on the top of this part. The support 4 has lugs 4A and 4B formed on its inner side surfaces. The holding part 3A is positioned between the inner side surfaces of the support 4. The right (left in FIG. 2A) edge of the top of the holding part 3A is positioned between the top inner surface of the support 4 and the lug 4A. The left (right in FIG. 2A) edges of the top and bottom of the holding part 3A are positioned between the top inner surface of the support 4 and the lug 4B. This keeps the support 4 from shifting relative to the holder 3 angularly on axes in the directions X and perpendicularly to these directions.

The cleaning roller 5, which is the cleaning member, is supported rotatably by lower end portions of the support 4. The roller 5 includes, as an example, an elastic body containing an abrasive lower in hardness than the material for the needle electrode 2 and higher in hardness than dust such as toner. The tips of the electrode needles 2A sink in the outer cylindrical surface of the roller 5.

The cleaning roller 5 can be made of a suitable elastic material selected experimentally from known rubber and resinous materials on the condition that it deforms elastically without being cut easily when the electrode needles 2A sink into it and come out of it. The abrasive of the roller 5 can be a material selected suitably from known materials on the condition that it can remove toner and dust from the surfaces of the needles 2A without damaging the surfaces. The abrasive can be contained in the elastic body by a known method.

The support 4 has a hole 4C cut through an upper part of it. The rear end of the operating shaft 6 is fixed in the hole 4C. With reference to FIG. 4, a front end portion of the shaft 6 protrudes from the front end of the holder 3.

The casing 7 extends over the whole length of the holder 3 and covers the support 4. The casing 7 shields the needle electrode 2.

When a high voltage is applied to the needle electrode 2 through the terminal in the end part 3B, the applied electric field concentrates at the tips of the electrode needles 2A, so that the tips are liable to discharge. This causes the needles 2A to discharge to the cylindrical surface of the photosensitive drum 31, so that this surface is charged to the preset potential.

The cross section of the holding part 3A which is perpendicular to the directions X is uniform in shape at least between both endmost needles 2A. As stated already, the support 4 is supported outside the holding part 3A and kept from shifting relative to the holder 3 angularly on axes in the directions X and perpendicularly to these directions. The support 4 can slide in the directions X along the holding part 3A at least between both endmost needles 2A.

Figure 3:
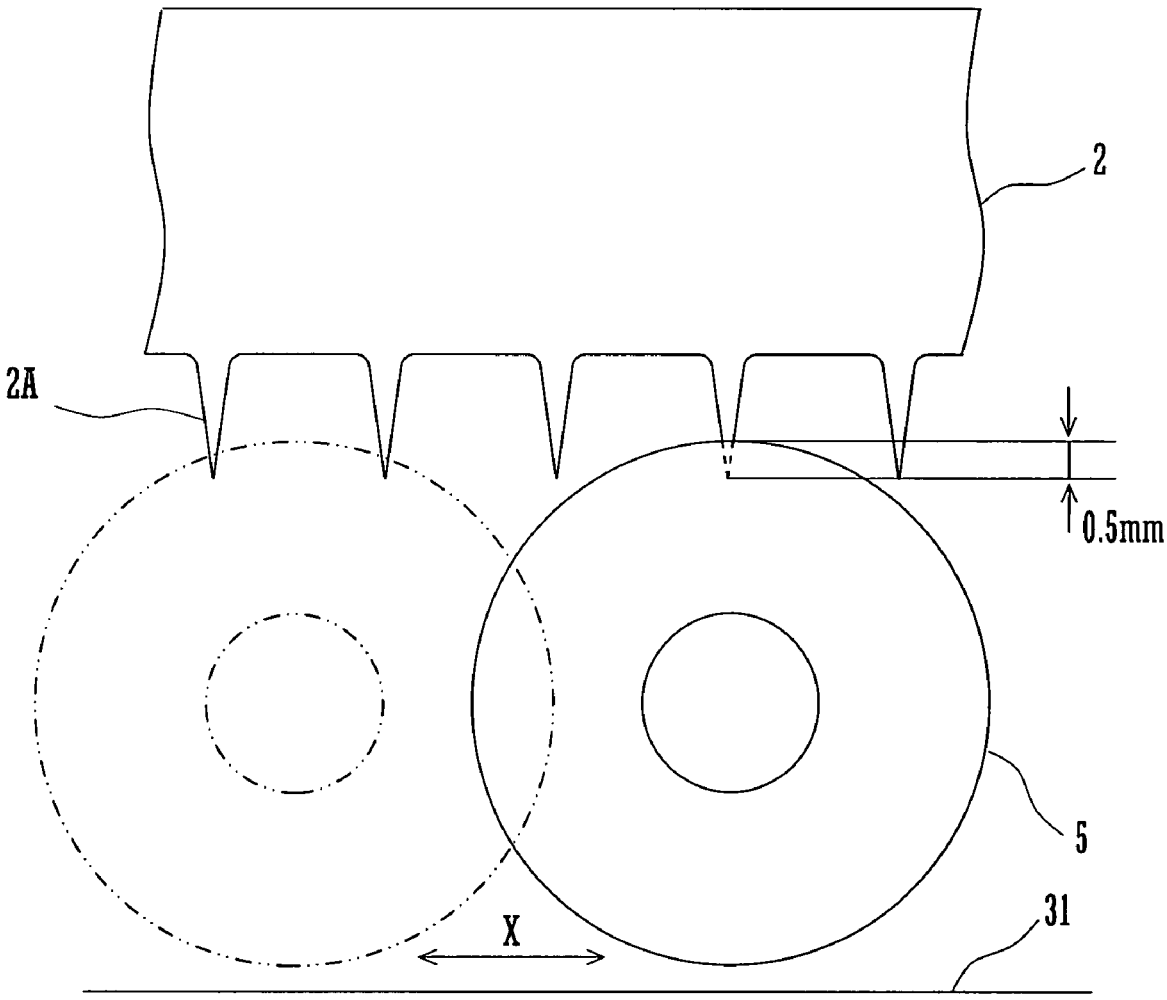
FIG. 3 is a further enlarged side view of part of the electrostatic charger according to the first embodiment, showing the cleaning operation of the cleaning roller of the charger.

FIG. 3 shows the cleaning operation of the cleaning roller 5. The tips of the electrode needles 2A sink in the outer cylindrical surface of the roller 5, which is supported rotatably by the support 4. While the support 4 is moving with the roller 5 in the directions X, the needle tips sink in order in the roller surface. While the roller 5 is moving in the directions X, it is rotated by the resistance acting from the needles 2A to the roller surface. While the roller 5 is moving in each direction X, it makes a number of rotations.

The cleaning roller 5 is positioned between the needle electrode 2 and the cylindrical surface of the photosensitive drum 31. It is essential that the roller 5 be as large as possible in diameter without being in contact with the drum surface. While the roller 5 is moving in the directions X, the tip of at least one electrode needle 2A is sinking in the outer cylindrical surface of this roller. This ensures that the roller 5 rotates when it moves in the directions X. As a result, the damage to the roller surface by the tips of the electrode needles 2A and the deformation of the needles by the roller surface are minimized.

The cleaning roller 5 is so supported by the support 4 that the electrode needles 2A sink as deep as about 0.5 mm into the roller. While the support 4 is moving with the roller 5 in the directions X, lower end portions of the needles 2A sink gradually into the roller 5 and subsequently come gradually out of it. While the needle portions are sinking into and coming out of the roller 5, their overall surfaces come into contact with the elastic body of the roller 5 and are ground by the abrasive contained in this body. Because the roller 5 rotates while the needles 2A are sinking into it and coming out of it in order, at least adjacent needles 2A sink in different positions into the roller 5. This ensures that the overall surfaces of lower end portions of the needles 2A are cleaned.

With reference to FIG. 4, the operating shaft 6 is positioned at the top of the electrostatic charger 1 and extends over the roughly whole length of the holder 3. As stated already, the rear end of the shaft 6 is fixed in the hole 4C (FIG. 2A) of the support 4. The holder 3 also includes a mounting part 9 formed at its front end, which is nearly identical in outer shape with the end part 3B. A bearing member 8 is fixed to the rear end of the mounting part 9. The bearing member 8 is identical with the support 4 and has a hole 4C cut through an upper part of it. The mounting part 9 has a bearing 9A formed at its top.

The operating shaft 6 extends through the hole 4C of the bearing member 8 and the bearing 9A of the mounting part 9. A handle 6A is fixed to the front end of the shaft 6. The end part 3B, the bearing member 8, and the mounting part 9 are positioned outside an image forming zone W on the cylindrical surface of the photosensitive drum 31 when the electrostatic charger 1 is mounted in the apparatus 100. In the meantime, while the cleaning roller 5 is not cleaning the electrode needles 2A, the support 4 is positioned in a stand-by position set outside the image forming zone W on the drum surface. Accordingly, the support 4, the end part 3B, the bearing member 8, and the mounting part 9 do not obstruct the image formation on the drum surface.

The operator cleans the needle electrode 2 by pulling and pushing the handle 6A to reciprocate the operating shaft 6 in the directions X. This reciprocates the support 4 with the cleaning roller 5 along the holding part 3A of the holder 3, so that the tips of the electrode needles 2A sink in order in the outer cylindrical surface of the rotating roller 5.

When lower end portions of the electrode needles 2A sink in order into and come in order out of the cleaning roller 5, the overall surfaces of the needle portions come into contact with the roller 5. This ensures that the overall surfaces of the needle portions are cleaned without the needles 2A deformed and fibers sticking to them.

The operating shaft 6 is supported at the three points on the support 4, the bearing member 8, and the bearing 9 and can be reciprocated smoothly in the directions X.

It is not essential that the cleaning member be the cleaning roller 5, but it is essential that this member be a rotor supported rotatably by the support 4.

Figure 2:
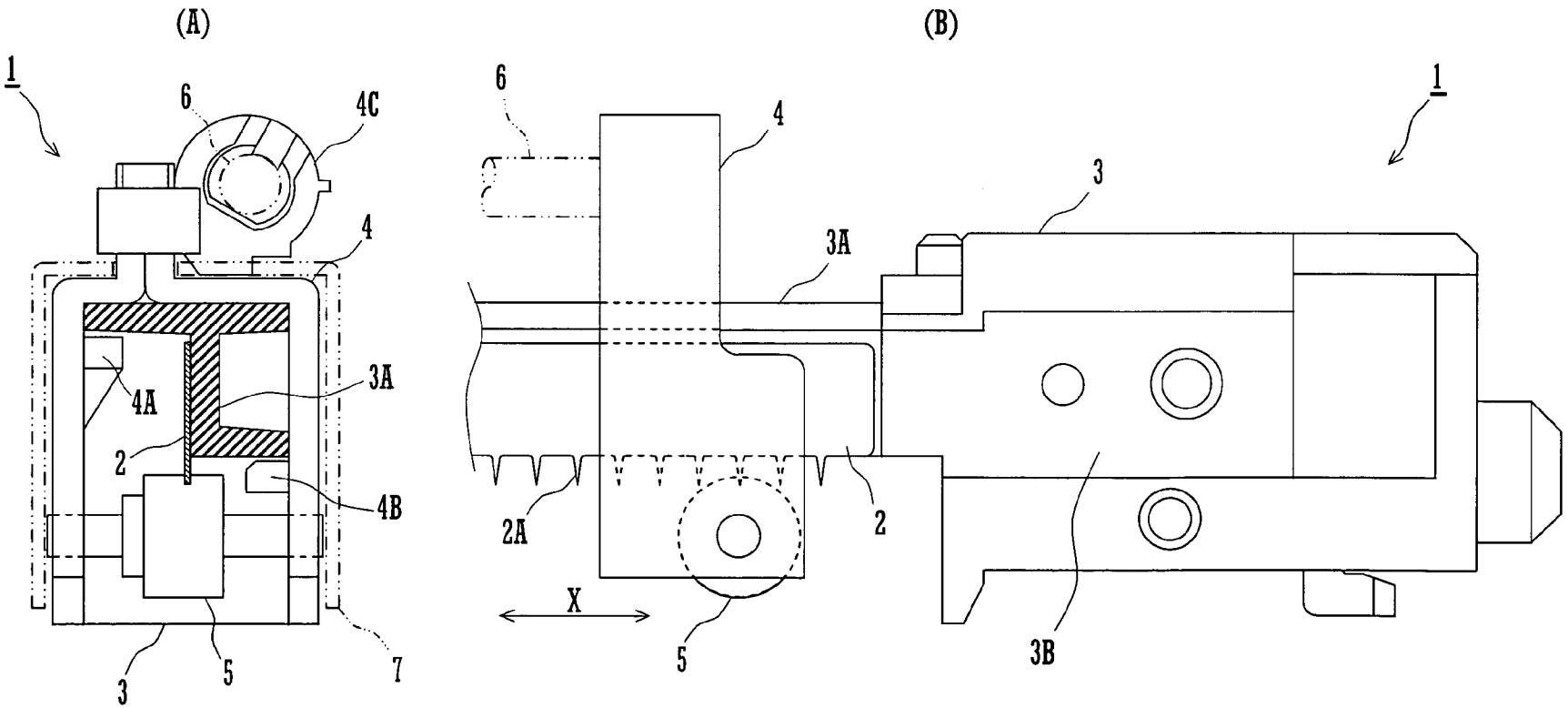
FIG. 2A is a front end view in cross section of the electrostatic charger according to the first embodiment.
FIG. 2B is an enlarged right side view of part of the charger.
Figure 5:
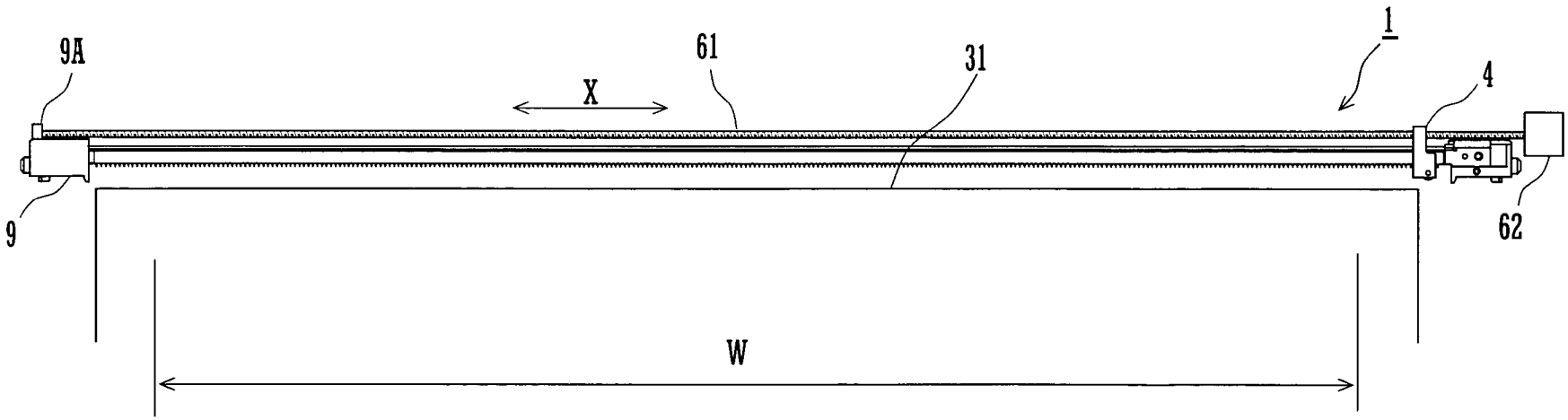
FIG. 5 is a right side view of an electrostatic charger.

FIG. 5 shows another embodiment of an electrostatic charger 1A. The charger 1A includes a threaded shaft 61 in place of the operating shaft 6 of the charger 1, which is shown in FIGS. 2-4. The charger 1A also includes a reversible motor 62 as a motive power source for rotating the shaft 61. The support 4 of the charger 1A has a tapped hole 4C formed through an upper part of it. The tapped hole 4C engages with the shaft 61.

The support 4 is kept from shifting relative to the holder 3 angularly around axes in the directions X. The torque of the threaded shaft 61 is converted into force for moving the support 4 along the shaft. The reversible motor 62 rotates the threaded shaft 61 in both directions so as to reciprocate the support 4 in the directions X. It is possible to clean the needle electrode 2 automatically by activating the motor 62 at preset times.

The apparatus 100 is fitted with an electric power source. The reversible motor 62 might be small in size and fitted to the electrostatic charger 1A. The small motor 62 could be connected electrically to the power source when the charger 1A is mounted in the apparatus 100. Alternatively, the motor 62 might be mounted in the apparatus 100. In this case, the rear end of the threaded shaft 61 could be coupled mechanically to the output shaft of the motor 62 when the charger 1A is mounted in the apparatus 100.

Figure 6:
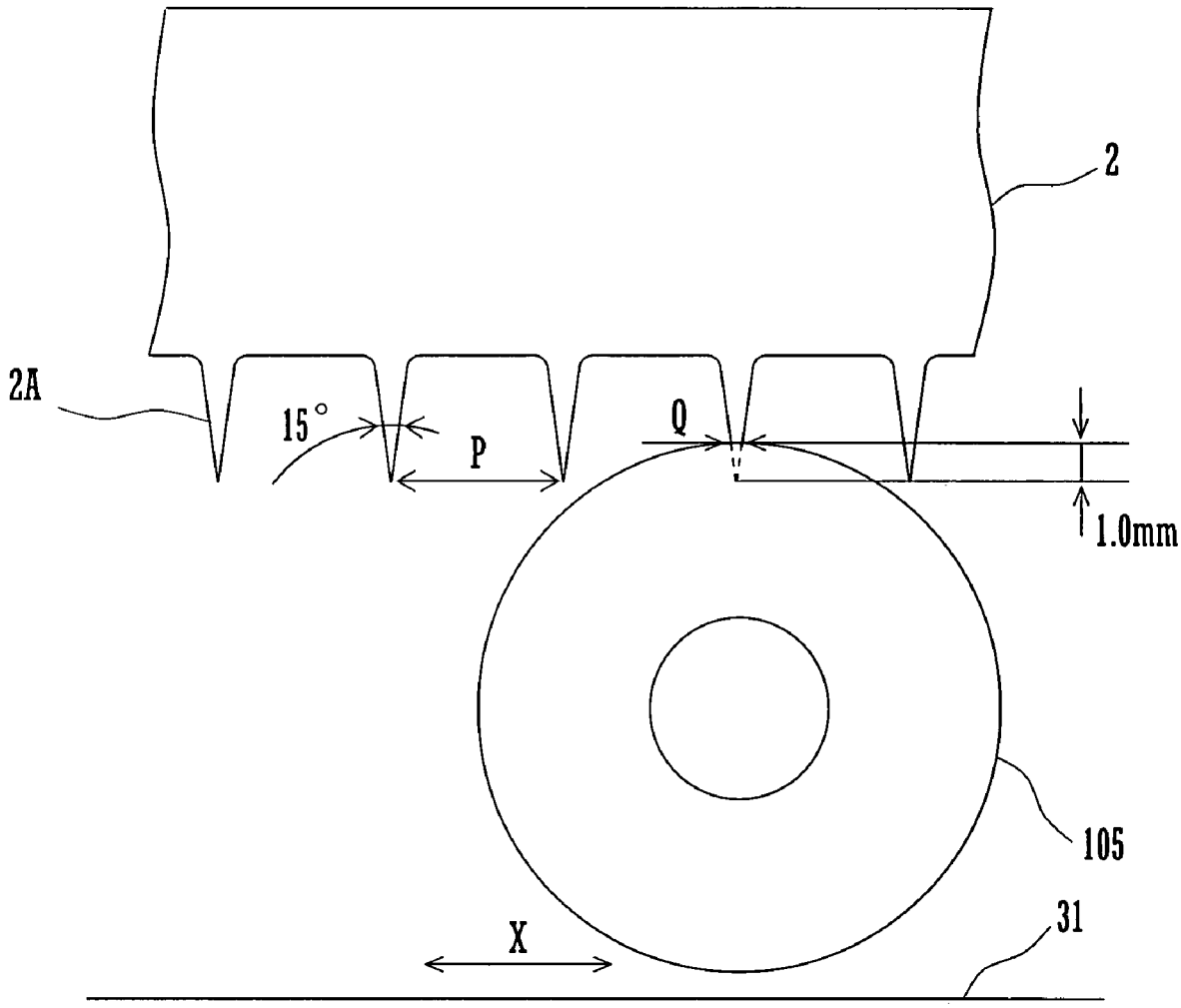
FIG. 6 is a side view of part of an electrostatic charger.

FIG. 6 shows another embodiment of an electrostatic charger 1B. The charger 1B is similar in structure to the charger 1, except that the peripheral length of the cleaning roller 105 of the charger 1B is preset as follows.

The electrode needles 2A of the electrostatic charger 1B have a tip angle of 15° and are arrayed at a pitch P of 2.0 mm. The cleaning roller 105 is so supported by the support 4 that the maximum depth to which the needles 2A sink into this roller is 1.0 mm. When each needle 2A sinks deepest into the roller 105, the cross section of the needle at the outer cylindrical surface of the roller has a length Q in the directions X which is calculated as follows.

$$Q=2\times1.0\times\tan(15°/2)=0.263(\text{mm})$$

The peripheral length R of the cleaning roller 105 is set at the sum of a given value $\alpha$ different from the needle pitch P and the product of the pitch P and a positive integer n. The peripheral length R is expressed by the following expression.

$$R=nP+\alpha(\alpha\neq P)$$

Specifically, the peripheral length R of the cleaning roller 105 is set at 18.84 mm (the diameter is 6 mm). The peripheral length R of 18.84 mm is the sum of 0.84 as a given value α and the product of the needle pitch P of 2.0 mm and 9 as a positive integer n.

If the peripheral length R of the cleaning roller 105 were the product of the needle pitch P and a positive integer n, electrode needles 2A would, when the roller 105 makes each rotation, sink in the same positions as other electrode needles 2A sank when this roller made the previous rotation.

The peripheral length R of the cleaning roller 105 is such that, when this roller makes each rotation while moving in the directions X, electrode needles 2A sink in positions where any other electrode needles 2A did not sink when the roller 105 made the previous rotation. This brings the roller 105 into more effective contact with the needles 2A, so that the tips of the needles are cleaned more efficiently. This also restrains the deterioration of the outer cylindrical surface of the roller 105, thereby lengthening the life of this roller.

It is preferable that the given value α be greater than the length Q in the directions X and smaller than the remainder of the needle pitch P from which the length Q is subtracted. In this case, the peripheral length R of the cleaning roller 105 is expressed by the following expression.

$$R=nP+\alpha(Q<\alpha<P-Q)$$

If the condition $Q<\alpha<P-Q$ is met, the condition $\alpha\neq P$ is met.

Figure 7:
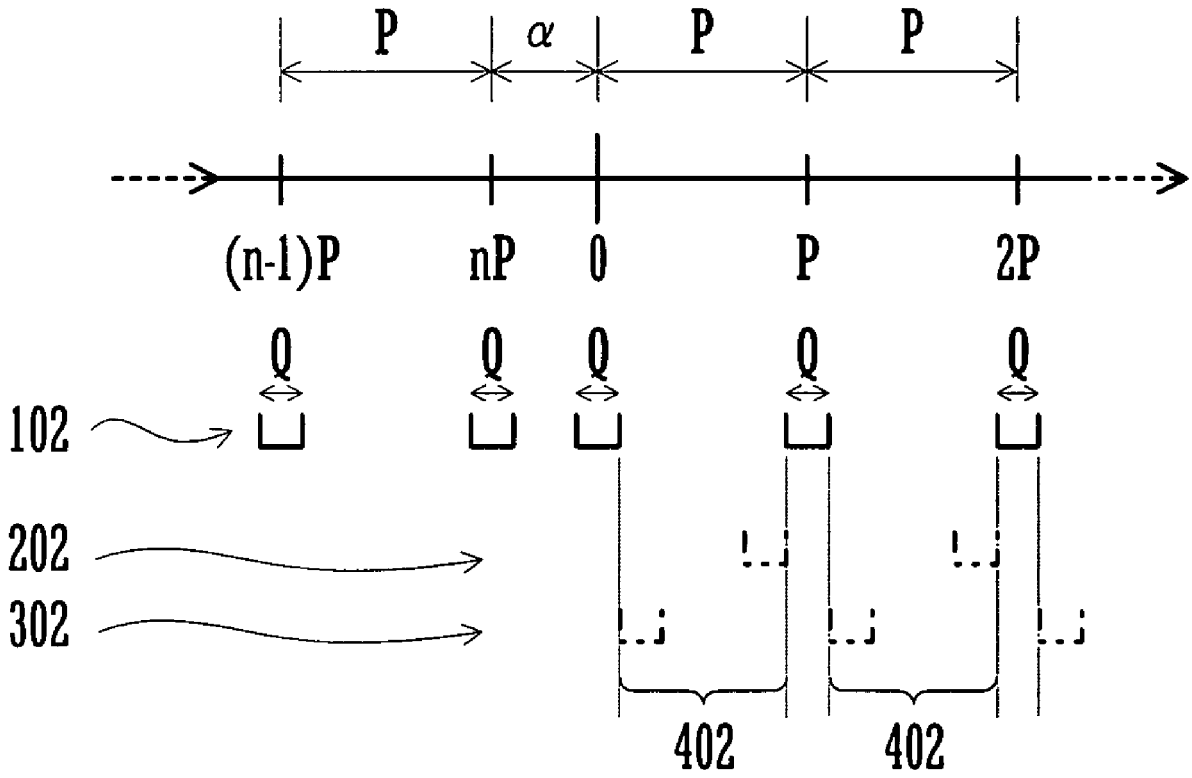
FIG. 7 is an explanatory drawing showing where electrode needles sink into cleaning rollers with different peripheral lengths when the rollers make each rotation.

FIG. 7 shows where electrode needles 2A sink into cleaning rollers with different peripheral lengths when the rollers make each rotation. When the cleaning roller 105 makes the first rotation, electrode needles 2A sink in positions 102 into this roller.

On the condition $\alpha=Q$, when the cleaning roller 105 makes the second rotation, electrode needles 2A would sink in positions 202. On the condition $\alpha<Q$, when the roller 105 makes the second rotation, electrode needles 2A would sink in positions shifted to the right from the positions 202 in FIG. 7. Specifically, on this condition, electrode needles 2A would sink in positions overlapping or coincident with the positions where other electrode needles 2A sank when the roller 105 made the first rotation.

On the condition $\alpha=P-Q$, when the cleaning roller 105 makes the second rotation, electrode needles 2A would sink in positions 302. On the condition $\alpha>P-Q$, when the cleaning roller 105 makes the second rotation, electrode needles 2A would sink in positions shifted to the left from the positions 302 in FIG. 7. Specifically, on this condition, electrode needles 2A would sink in positions overlapping or coincident with the positions where other electrode needles 2A sank when the roller 105 made the first rotation.

As stated already, it is preferable that the given value α be greater than the length Q in the directions X and smaller than the remainder of the needle pitch P from which the length Q is subtracted ($Q<\alpha<P-Q$). In this case, when the cleaning roller 105 makes each rotation, electrode needles 2A sink into this roller within ranges 402 neither overlapping with nor covering the positions where other electrode needles 2A sank when the roller 105 made the previous rotation. This makes it easy for the roller 105 to come into contact with the tips of the needles 2A, so that the tips can be cleaned more efficiently. This also restrains the deterioration of the outer cylindrical surface of the roller 105, so that the life of this roller can be longer.

Figure 8:
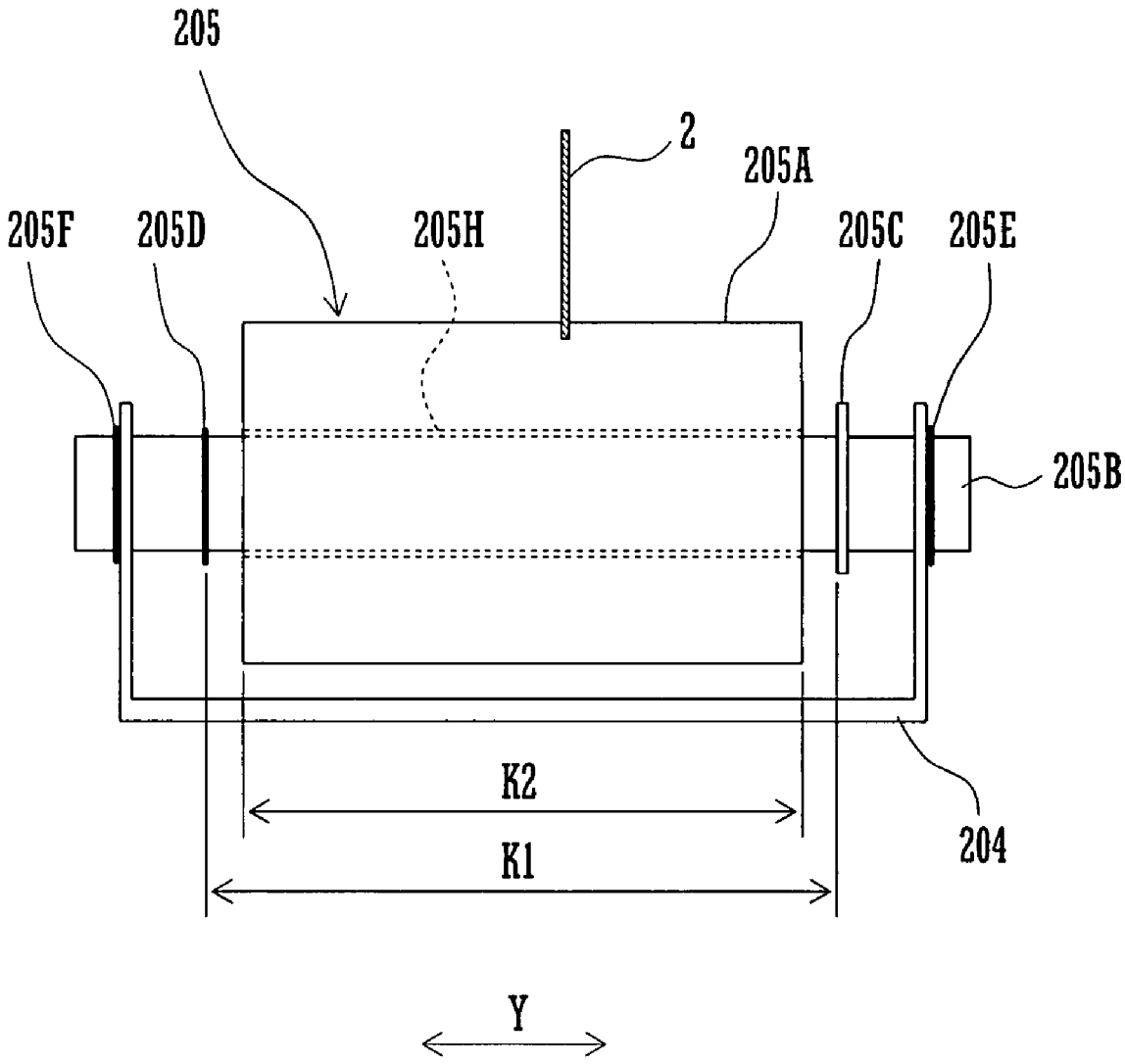
FIG. 8 is a front end view of the cleaning roller of an electrostatic charger.

FIG. 8 shows the cleaning roller 205 of another embodiment of an electrostatic charger 1C. The roller 205 includes a cylindrical rotor 205A and a shaft 205B. The charger 1C is similar in structure to the charger 1, except that the rotor 205A can shift within a preset range in the directions Y axial of the roller 205. The tips of the electrode needles 2A of the charger 1C sink in the outer cylindrical surface of the rotor 205A.

The roller rotor 205A has a bore 205H formed through its center, which extends in the directions Y. The directions Y are perpendicular to the directions X in which the electrode needles 2A are arrayed. The rotor 205A is, as an example, an elastic body containing an abrasive.

The roller shaft 205B extends through the rotor bore 205H perpendicularly to the directions X and is supported rotatably by both ends of a support 204. The shaft 205B is fitted with E rings 205E and 205F outside both ends of the support 204. The rings 205E and 205F keep the shaft 205B from shifting axially relative to the support 204.

Figure 9:
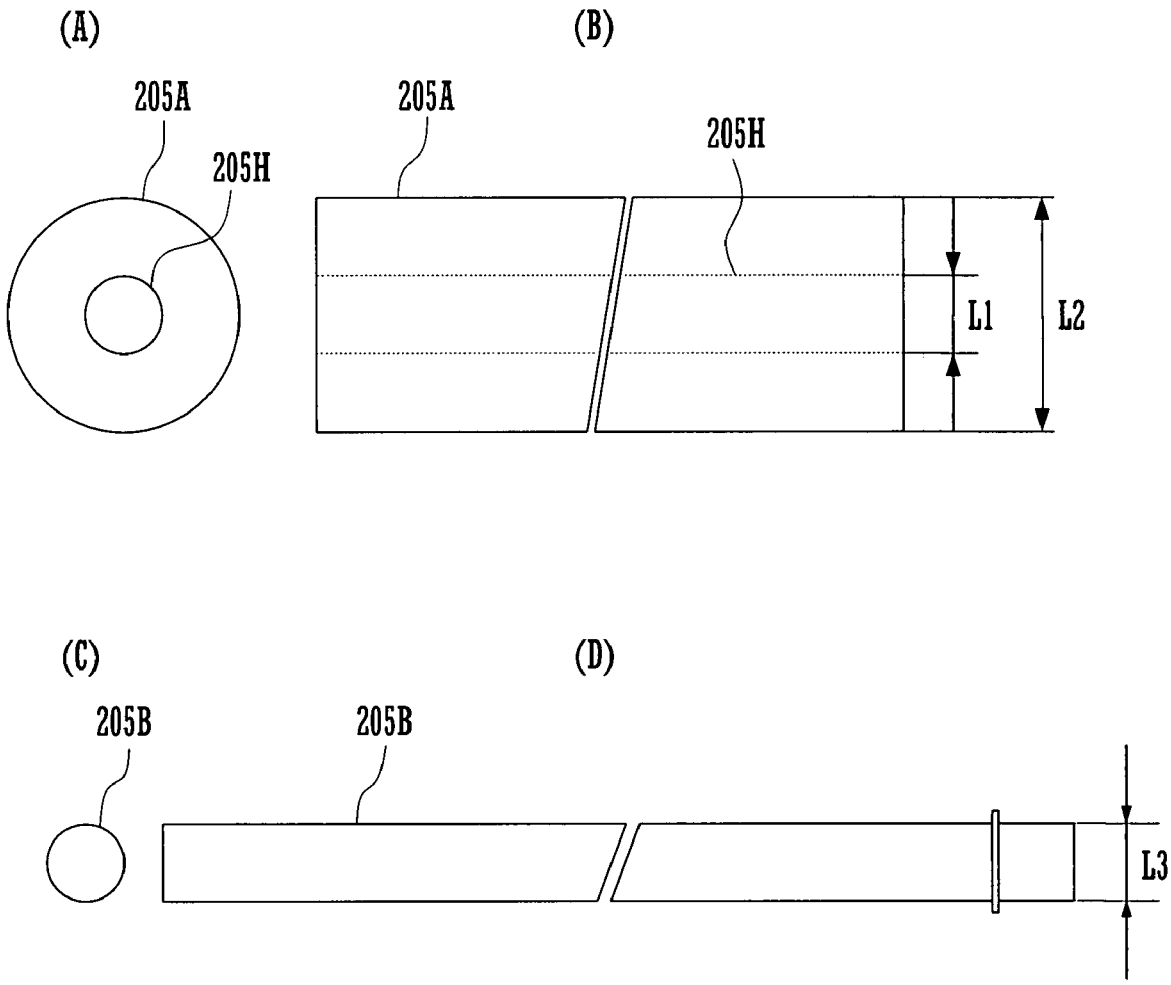
FIGS. 9A and 9B are a side view and a front end view respectively of the rotor of the cleaning roller of the electrostatic charger.
FIGS. 9C and 9D are a side view and a front end view respectively of the shaft of the cleaning roller of the electrostatic charger.

With reference to FIG. 9B, the inner diameter L1 of the roller rotor 205A is, as an example, 3.5 mm with a tolerance between 0.0 and +0.5 mm. With reference to FIG. 9B, the outer diameter L2 of the rotor 205A is, as an example, 6.0 mm with a tolerance between −0.3 and +0.3 mm. With reference to FIG. 9D, the diameter L3 of the roller shaft 205B is, as an example, 3.0 mm with a tolerance between −0.25 and +0.25 mm.

The roller rotor 205A is supported rotatably on the roller shaft 205B, which extends through the rotor bore 205H in the directions Y. There is a clearance between the cylindrical surface of the shaft 205B and the inner circumferential surface of the rotor bore 205H. If the inner diameter L1 of the rotor 205A is 4.0 mm, and if the diameter L3 of the shaft 205B is 2.75 mm, the maximum clearance between cylindrical surface of the shaft 205B and the inner circumferential surface of the rotor bore 205H is 1.25 mm. If the rotor diameter L1 is 3.5 mm, and if the shaft diameter L3 is 3.25 mm, the maximum clearance is 0.25 mm.

The clearance between cylindrical surface of the roller shaft 205B and the inner cylindrical surface of the roller rotor 205A makes it easy for the rotor to shift axially relative to the shaft. Because the shaft 205B is not press-fitted in the rotor 205A, the outer cylindrical surface of the rotor is not liable to crack even if the cleaning roller 205 cleans the electrode needles 2A many times.

The roller shaft 205B has a rib 205C formed on it, which is positioned between the E rings 205E and 205F. An E ring 205D is fixed on the cylindrical surface of the shaft 205B between the rib 205C and the E ring 205F. The roller rotor 205A is positioned between the rib 205C and the E ring 205D. The distance K1 between the rib 205C and the E ring 205D is longer than the length K2 of the rotor 205A so that the rotor 205A can shift axially relative to the electrode needles 2A between the rib 205C and the E ring 205D.

The rib 205C and the E ring 205D correspond to the stoppers.

Because the roller rotor 205A can shift axially within the preset range relative to the electrode needles 2A, the rotor shifts in the directions Y as the cleaning roller 205 moves in the directions X. Accordingly, the positions where the needles 2A sink into the rotor 205A vary in the directions Y. This greatly decreases the frequency at which the needles 2A sink into and come out of the rotor 205A on the same plane radial of the rotor. As a result, the tips of the needles 2A can be cleaned more efficiently, and the deterioration of the cylindrical surface of the rotor 205A is restrained, so that the life of the roller 205 is lengthened. This restrains the decrease in image formation efficiency and the rise in cost which are caused by frequent replacement of the roller 205.

Figure 10:
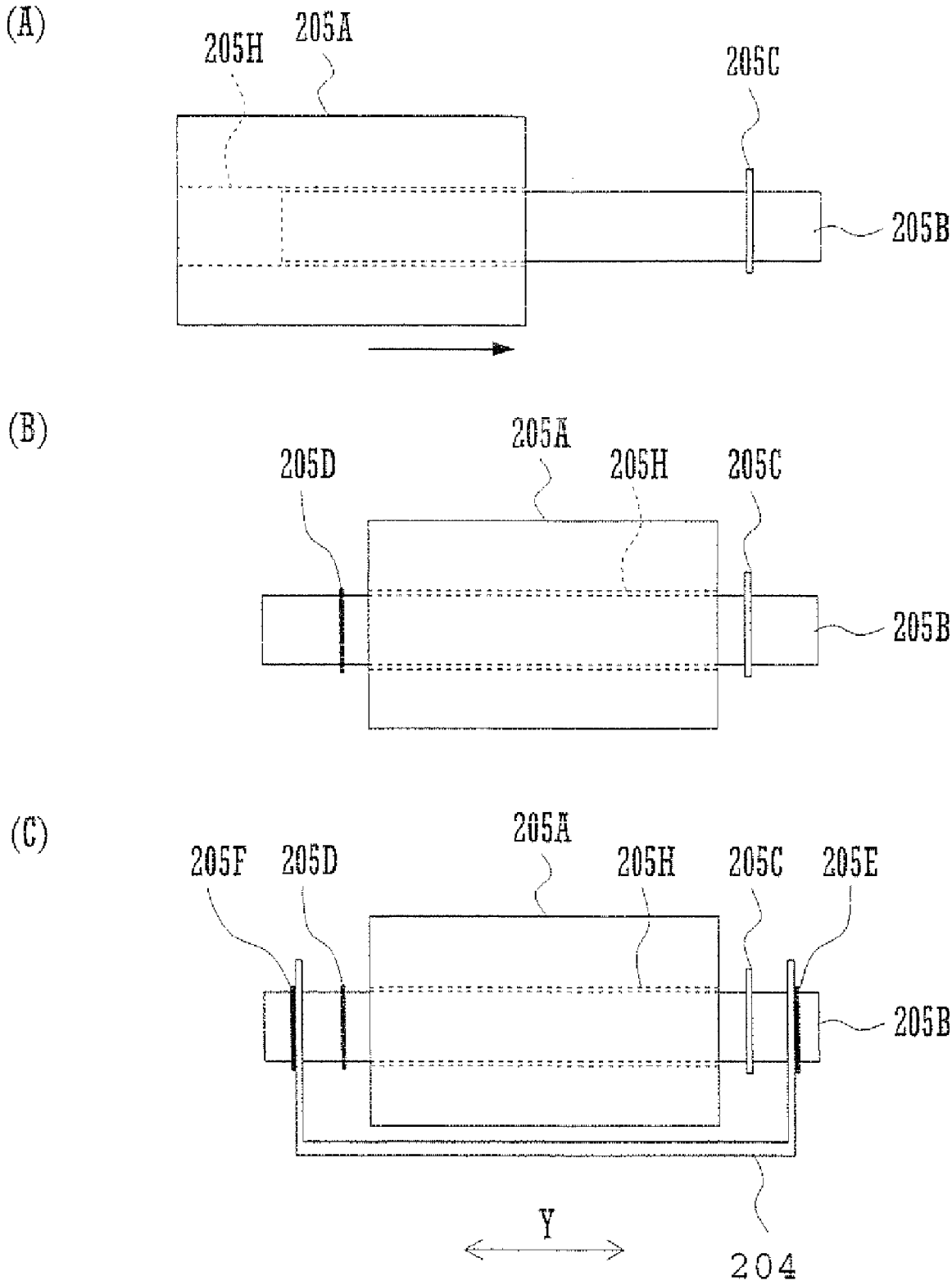
FIGS. 10A-10C are front end views of the cleaning roller of the electrostatic charger, showing the order in which the roller is assembled.

FIGS. 10A-10C show the order in which the cleaning roller 205 is assembled. By way of example, the roller 205 can be assembled as follows. First, an end portion of the roller shaft 205B which is away from the rib 205C is inserted through the rotor bore 205H. Next, the E ring 205D is fixed to the specified position on this shaft portion. Next, end portions of the shaft 205B are inserted through the holes in both ends of the support 204. Next, the E rings 205E and 205F are fixed on the shaft 205B outside the support 204.

The rib 205C is formed integrally with the roller shaft 205B at the manufacturing stage, so that the rib 205C is positioned accurately relative to the shaft. This accurately sets one of the limit positions between which the roller rotor 205A shifts axially relative to the electrode needles 2A. The E ring 205D is fixed on the shaft 205B while positioned at the assembly stage, so that the other limit position is easy to adjust at this stage. As a result, the limit positions are set accurately.

The rib 205C and the E ring 205D are smaller in outer diameter than the roller rotor 205A, so that they are out of contact with the needle electrode 2 etc. when the cleaning roller 205 is supported under the electrode.

The E rings 205D, 205E, and 205F might be replaced by C rings, O rings, snap rings, or other stoppers in the form of circles or rings. The rib 205C might be replaced by an E ring, a C ring, an O ring, a snap ring, or another stopper in the form of a circle or a ring.

Bearings or other sliding members might be interposed between the inner circumferential surface of the rotor bore 205H and the cylindrical surface of the roller shaft 205B so that the roller rotor 205A could shift axially relative to the electrode needles 2A.

The roller rotor 205A and the roller shaft 205B might be formed integrally with each other so that the whole of the cleaning roller 205 could shift axially relative to the electrode needles 2A.

Figure 11:
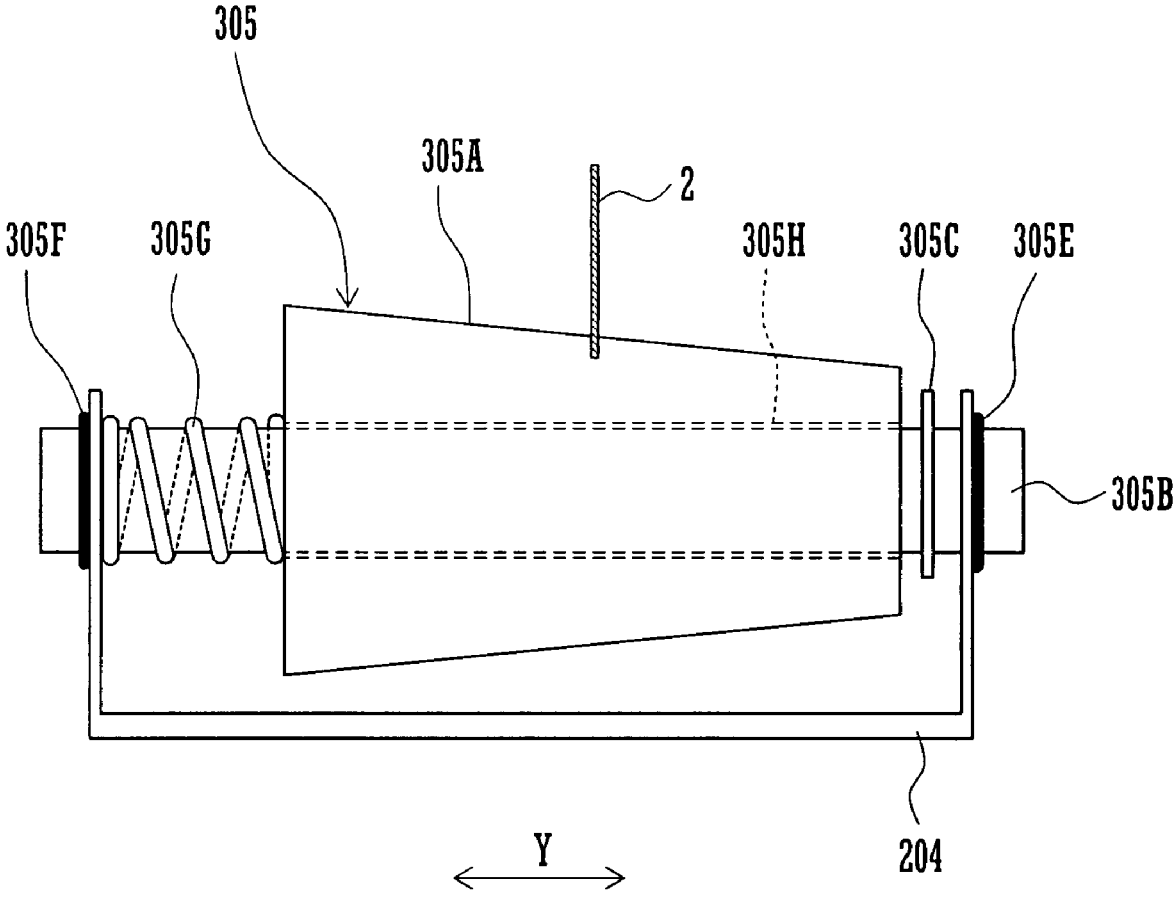
FIG. 11 is a front end view of the cleaning roller of an electrostatic charger.

FIG. 11 shows the cleaning roller 305 of another embodiment of an electrostatic charger 1D. The roller 305 includes a rotor 305A, a shaft 305B, and a compression spring 305G as an elastic member. The charger 1D is similar in structure to the charger 1C, except that the rotor 305A is a truncated cone biased axially.

The rib 305C of the roller shaft 305B is adjacent to the end of the roller rotor 305A which is smaller in diameter than the other end. The compression spring 305G surrounds the shaft 305B between the rotor end larger in diameter and the adjacent end of the support 204. The spring 305G biases the rotor 305A axially toward the rib 305C as a stopper.

While the cleaning roller 305 is moving in the directions X, with electrode needles 2A sinking into the roller rotor 305A, the needles 2A apply pressure on the conical surface of the rotor 305A. The pressure shifts the rotor 305A axially away from the rib 305C against the biasing force of the compression spring 305G. As a result, the needles 2A sink along a spiral on the rotor surface.

When the support 204 has moved to one end of the holding part 3A, no electrode needle 2A sinks into the roller rotor 305A, so that the biasing force of the compression spring 305G shifts the rotor axially toward the rib 305C. While the support 204 is moving from this end of the holding part 3A to the other end, the needles 2A sink again along a spiral on the conical surface of the rotor 305A.

This greatly decreases the frequency at which electrode needles 2A sink in the same positions as other electrode needles 2A have sunk into the roller rotor 305A. As a result, the needles 2A can be cleaned more efficiently, and the deterioration of the conical surface of the rotor 305A is restrained, so that the life of the cleaning roller 305 is lengthened.

The compression spring 305G might be replaced by rubber or another elastic member.

The foregoing description of the embodiments should be considered to be illustrative in all respects and nonrestrictive. The scope of the present technology is defined by the appended claims, not by the embodiments, and intended to include meanings equivalent to those in the claims and all modifications within the scope of the claims.

What is claimed is:

1. An electrostatic charger comprising:

a needle electrode having a linear array of needles;

a support movable along the linear array; and a cleaning member supported by the support rotatably on an axis perpendicular to the linear array;

wherein, while the support is moving with the cleaning member along the linear array, the cleaning member rotates, with the needles sinking in order into and subsequently coming in order out of the cleaning member; and wherein a circumference of the cleaning member is selected such that even if the cleaning member does not axially move while it rotates, when the cleaning member makes each rotation while moving with the support, the needles sink into the cleaning member at positions other than positions at which other needles were sunk into the cleaning member during a previous rotation.

2. An electrostatic charger as claimed in claim 1, wherein the cleaning member comprises:

a shaft supported by the support and a rotor having a bore formed therethrough;

the shaft extending through the bore perpendicularly to the linear array;

the rotor being capable of shifting within a preset range along the shaft.

3. An electrostatic charger as claimed in claim 2, wherein a clearance is formed between the peripheral surface of the shaft and the inner circumferential surface of the rotor.

4. An electrostatic charger as claimed in claim 2, further comprising a restrictor provided on the shaft for restricting the movement of the rotor along the shaft within the preset range.

5. An electrostatic charger as claimed in claim 4, wherein the restrictor is a rib formed on the peripheral surface of the shaft.

6. An electrostatic charger as claimed in claim 4, wherein the restrictor is a stopper fixed to the shaft.

7. An electrostatic charger as claimed in claim 1, wherein the needles are arrayed at a constant pitch, and wherein the circumference of the cleaning member is the sum of a given value different from the pitch and the product of the pitch and a positive integer.

8. An electrostatic charger as claimed in claim 7, wherein the given value is greater than the length in parallel with the linear array of the cross section at the peripheral surface of the cleaning member of each of the needles having sunk deepest into the cleaning member, and wherein the given number is smaller than the remainder of the pitch from which the length in parallel with the linear array is subtracted.

9. An electrostatic charger, comprising:

a needle electrode having a linear array of needles;

a support movable along the linear array;

a shaft supported by the support, a longitudinal axis of the shaft being oriented perpendicular to a longitudinal axis of the needle electrode;

a cleaning member that is rotatably supported on the shaft such that as the support moves with the cleaning member along the linear array, the cleaning member rotates, with the needles sinking into and subsequently coming out of the cleaning member, wherein a circumference of the cleaning member and a pitch between adjacent needles of the linear array are selected such that even if the cleaning member does not move axially while it rotates, during each rotation of the cleaning member the needles sink will sink into positions on the cleaning member other than positions at which needles were sunk into the cleaning member during the previous rotation; and at least one restrictor in the shape of a ring that extends around a circumference of the shaft, the at least one restrictor restricting movement of the cleaning member along the shaft to within a preset range.

10. The electrostatic charger of claim 9, wherein the at least one restrictor comprises:

a first restrictor located on a first side of the cleaning member; and a second restrictor located on a second side of the cleaning member.

11. The electrostatic charger of claim 10, wherein the first restrictor comprises a rib formed on the shaft.

12. The electrostatic charger of claim 11, wherein the second restrictor comprises a ring that is removably mounted on the shaft.

13. An electrostatic charger, comprising:

a needle electrode having a linear array of needles;

a support movable along the linear array;

a shaft supported by the support, a longitudinal axis of the shaft being oriented perpendicular to a longitudinal axis of the needle electrode;

a cleaning member that is rotatably supported on the shaft such that as the support moves with the cleaning member along the linear array, the cleaning member rotates, with the needles sinking into and subsequently coming out of the cleaning member; and at least one restrictor in the shape of a ring that extends around a circumference of the shaft, the at least one restrictor restricting movement of the cleaning member along the shaft to within a preset range, wherein the following formula are satisfied:

$$R=nP+\alpha$$

$$Q<\alpha<(P-Q)$$

where R is the circumference of the cleaning member, n is a positive integer, P is a pitch between adjacent needles of the linear array, $\alpha$ is an arbitrary distance that is not equal to the pitch P, and Q represents the width of the portion of a needle that is level with the exterior surface of the cleaning member when the needle is sunk the maximum distance into the cleaning member as the cleaning member rotates.

* * * * *